US005809667A

United States Patent [19]

Liautaud

[11] Patent Number: 5,809,667

[45] Date of Patent: Sep. 22, 1998

[54] SNOWSHOE HAVING SNAP-ON CLAW PLATE

[76] Inventor: Jeffrey T. Liautaud, 431 S. Western, Park Ridge, Ill. 60068

[21] Appl. No.: 377,725

[22] Filed: Jan. 24, 1995

Related U.S. Application Data

[63] Continuation-in-part of Ser. No. 239,268, May 6, 1994.

[51] Int. Cl.[6] ..... A43B 5/04; A43B 5/16

[52] U.S. Cl. ..... 36/122; 36/124; 36/125

[58] Field of Search ..... 36/122, 123, 124, 36/125, 131, 107, 108, 113, 134, 67 D, 59 R, 62; 280/204

[56] References Cited

U.S. PATENT DOCUMENTS

| | | | |
|---|---|---|---|
| 1,004,900 | 10/1911 | Pease . | |
| 2,511,087 | 1/1950 | Villemur . | |
| 2,699,613 | 1/1955 | Peterson . | |
| 2,738,596 | 3/1956 | Walsh . | |
| 2,769,250 | 11/1956 | Rinkinen . | |
| 3,344,538 | 10/1967 | Massicotte . | |
| 3,638,333 | 2/1972 | Sprandel . | |
| 3,802,100 | 4/1974 | Prater . | |
| 3,992,790 | 11/1976 | Frye . | |
| 4,085,529 | 4/1978 | Merrifield | 36/122 |
| 4,259,793 | 4/1981 | Morgan, Jr. et al. | 36/122 |
| 4,351,121 | 9/1982 | Wallace . | |
| 4,604,817 | 8/1986 | Ramboz . | |
| 4,620,375 | 11/1986 | Wallace . | |
| 4,720,927 | 1/1988 | Abegg . | |
| 4,720,928 | 1/1988 | Faber et al. . | |
| 5,253,437 | 10/1993 | Kleban et al. | 36/122 |
| 5,259,128 | 11/1993 | Howell | 36/122 |

*Primary Examiner*—M. D. Patterson
*Attorney, Agent, or Firm*—Michael, Best & Friedrich

[57] ABSTRACT

A snowshoe includes a perimeter frame carrying sheet-type floatation and having a hinge rod supported transversely of the frame. A bearing sleeve or bushing is disposed about the hinge rod and a cooperates therewith to enable snap-on assembly and release of a claw plate having a binding supported thereon, thereby enabling interchanging of claw plates and bindings for a particular snowshoe frame and decking. The hinge rod and bushing cooperate to vary the frictional resistance to relative rotation between the claw plate and hinge rod, and thereby provide a shock absorber effect. Various features of the claw plate enable adjustment of the frictional resistance to rotation of the claw plate about the hinge rod to accommodate different uses of the snowshoe and different characteristics of the user. Other features include an improved arrangement for securing the outer marginal edge of the sheet-type decking or floatation material to the frame.

12 Claims, 3 Drawing Sheets

SNOWSHOE HAVING SNAP-ON CLAW PLATE

BACKGROUND OF THE INVENTION

This is a continuation-in-part from application Ser. No. 08/239,268, filed May 6, 1994, which is incorporated herein by reference.

The present invention relates generally to snowshoes, and more particularly to a novel snap-on claw plate enabling easy interchanging of bindings and claw plates on a snowshoe for particular user and snow terrain characteristics.

Snowshoes have traditionally been used as a convenient means to traverse relatively deep snow. With the increased interest in outdoor activities, such as hiking and the like, the use of snowshoes in the backcountry has grown significantly. More recently, there has been increased interest in running or jogging on snowshoes, including the holding of races with the runners wearing snowshoes. Racing events have special requirements. For example, each runner's snowshoes must meet certain minimum size standards in width and length, generally 8" wide and 25" in length. Further, in running on snowshoes it is highly desirable that any articulated movement between the snowshoe and the runner's foot or boot be controlled so as to prevent rotation of the snowshoe to a position wherein the toe end of the snowshoe engages the user's shin or ankle, and also prevent rotation in an opposite direction to a point where the tail end of the snowshoe effects a shock-like slapping of the snowshoe against the user's foot when the snowshoe is lifted from the surface of the snow.

Conventional snowshoes have a frame which forms the perimeter of the snowshoe and is generally made of wood or a tubular lightweight metal such as aluminum. The perimeter frame may be reinforced by transverse cross bars and has floatation means secured thereto, such as a traditional webbing laced tight to the frame. Early snowshoe designs provided for relatively loose attachment of the snowshoe to the user's foot so that sideways slop was allowed between the snowshoe and the user's boot. More recent snowshoe designs employ a hinge rod which is fixed transversely to the frame to underlie the ball of the user's foot. The hinge rod pivotally supports a relatively rigid foot or claw plate through a retainer plate secured to the underside of the claw plate. A binding to receive the user's shoe or boot is secured to the top of the claw plate and one or more cleats or calks are preferably formed integral with or fixed to the bottom of the claw plate to provide better gripping when traversing packed snow or ice. A tubular bearing, such as a plastic sleeve or bushing, is preferably coaxial on the hinge rod to minimize friction between the hinge rod and its pivotal connection to the claw plate. A snowshoe of this general construction is disclosed in U.S. Pat. No. 3,802,100 which is incorporated herein by reference.

While snowshoes of the aforedescribed type have performed generally satisfactorily, they lack optimum performance and convenience-of-use characteristics desired in snowshoes used in backcountry snowshoeing on both packed and powered snow. In backcountry snowshoeing in relatively deep powder, it is important that vertical lift of the tail of the snowshoe be minimized since snow generally accumulates on top of the snowshoe tail and thereby requires greater expenditure of energy to lift the snowshoe with each step taken. Thus, snowshoes intended for backcountry snowshoeing generally enable the user's foot to freely pivot about the hinge rod so that the toe of the snowshoe comes up off the snow while the tail drags along the snow surface. This provides minimal lifting of the snowshoe upon pivotal movement of the user's foot during a forward step.

Running or jogging on snowshoes of the aforedescribed type, particularly on packed snow, is generally made more difficult by the free pivot and relative ease with which the foot or claw plate pivots about the hinge rod as on a snowshoe intended for backcountry use. As the jogger or runner takes each step, the foot initially pivots forwardly followed by lifting of the snowshoe so that the forward and tail ends lift off the surface of the snow. With prior snowshoes, as the snowshoe is lifted from the snow surface, the toe end may slap against the user's shin with resultant bruising and soreness. To prevent such action, prior snowshoes have employed a strap having one end fixed to the frame of the snowshoe generally adjacent its tail end and having an opposite end secured to either the trailing end of the claw plate or adapted for connection to the binding holding the user's boot or shoe. The strap limits angular rotation of the snowshoe frame relative to the foot plate to an included angle of approximately 45°. This technique, however, has a significant disadvantage in that the strap causes the frame and floatation webbing or decking to lift off the snow and continue forward with considerable momentum that results in a snap or slap against the user's heel. The resulting slapping noise is annoying in addition to imparting an undesirable upward force on the user's foot. This force takes energy away from the runner as the runner moves his foot back to its natural position.

It is known that the particular use to which a snowshoe will be put, such as backcountry snowshoeing on different terrains and snow conditions, subjects the snowshoe to significantly different operating conditions and demands. For example, backcountry snowshoeing in hilly or mountainous terrain generally calls for a claw plate and binding quite different than that required for backcountry snowshoeing on a relatively flat terrain in order to achieve optimum performance. Similarly, the characteristics of the snowshoe also may call for a claw plate or binding of a particular design to meet the physical size and strength of the snowshoer as well as the snowshoer's proficiency. Thus, a claw plate which enables ready interchangeability with other claw plates to facilitate changing to a claw plate having optimum performance for a particular set of conditions and which also enables easy changing of bindings would provide significant advantages over prior known claw plates and bindings.

Another factor that varies with the particular conditions to which a snowshoe will be subjected is the manner of attaching the floatation decking to a snowshoe perimeter frame. In snowshoe designs where the floatation decking comprises a closed sheet material secured at its periphery to and internally of a tubular type perimeter frame and is subjected to particularly arduous stresses, such as in climbing relatively steep hills or traversing rocks, the manner of attaching the decking to the snowshoe frame must be such that the decking will not break free from the frame. Conventional techniques for securing the peripheral edge of a sheet-type decking material to a perimeter snowshoe frame includes lashing the decking edge to the frame with a generally continuous spiral lashing. Another technique is to secure the deck material to the perimeter frame by a plurality of connector straps spaced along and looped about the perimeter frame with their opposite ends secured in an overlapping sandwiched relation with the peripheral edge of the decking material by rivets. While the use of rivets to secure the deck material to the snowshoe frame provides manufacturing and cost advantages over the use of spiral lashing, the rivet connections are often subjected to relatively high concentrated stresses when traversing steep hills or rocky terrain, and may break or become released from the decking material. A combination spiral lashing/rivet connection of the decking to the snowshoe perimeter frame would greatly enhance resistance to failure of the rivet joints and the lashing would provide a safety backup connection in the event one or more of the rivet connections were to fail.

SUMMARY OF THE INVENTION

One of the primary objects of the present invention is to provide a novel claw plate for a snowshoe of the type having a generally transverse hinge rod and wherein the claw plate has a snap-on retainer plate enabling relatively easy interchanging of claw plates and bindings for different conditions.

A more particular object of the present invention is to provide a novel snowshoe and claw plate combination wherein the claw plate is adapted for snap-on mounting on a transverse hinge rod of a snowshoe and facilitates interchanging of claw plates and bindings for particular application such as backcountry deep powder snowshoeing or running or jogging on relatively packed snow.

Another object of the present invention is to provide a novel claw plate for use with a snowshoe of the type having a transverse pivot rod, the claw plate having a retainer plate secured to its lower surface and configured to cooperate with the claw plate to enable releasable snap-on connection to the pivot rod.

A still further object of the present invention is to provide a novel claw plate and snowshoe combination wherein the snowshoe has a transverse pivot rod having diametrically opposed planar surfaces and having a low friction cylindrical bushing supported coaxially on the pivot rod, and wherein the claw plate has a retainer plate secured to its lower surface and configured to cooperate with the claw plate to enable relatively low resistance to snap-on assembly onto and release from the pivot rod when the claw plate is oriented in a particular angular orientation relative to the snowshoe, the retainer plate and pivot rod cooperating to provide greater resistance to release of the claw plate from the pivot rod when the claw plate and associated binding are disposed in their normal angular range of movement during use of the snowshoe.

Another object of the present invention is to provide a snowshoe having a novel arrangement for securing a sheet-type decking or floatation material to a perimeter frame wherein straps are looped about the frame at spaced intervals and have their ends secured in overlapping relation with adjacent marginal edges of the decking by rivets, and wherein forward and rear elongated lashing members have their opposite ends fixedly secured by cage clips, the length of each lashing member between its fixed ends being spirally wound around the adjacent frame and passing through openings in the adjacent marginal edge of the decking to secure the decking to the frame.

In carrying out the present invention, a snowshoe is provided which, in its preferred embodiment, includes a lightweight tubular metallic frame that defines the perimeter of the snowshoe and has substantially greater longitudinal length than transverse width. A closed sheet-like decking or floatation material is secured interiorly of the frame and enables the frame to resist downward movement into powder snow. A hinge rod has its opposite ends secured to the frame so that the hinge rod extends transversely of the frame and underlies the position assumed by the ball of the user's foot. A low friction tubular bearing sleeve or bushing is preferably coaxial about the hinge rod so that the rod and sleeve are adapted to receive and pivotally support a claw plate having a generally U-shaped retainer plate secured to its lower surface. The retainer plate cooperates with the claw plate to provide a snap-on pivotal connection between the claw plate and the hinge rod. A binding is secured to a top surface of the claw plate to facilitate attachment of the snowshoe to a user's shoe or boot.

The portion of the hinge rod about which the bearing sleeve is disposed has a non-circular transverse cross-sectional configuration so as to define at least one outwardly facing cam surface, and preferably a pair of cam surfaces defined by diametrically opposite arcuate external surfaces formed along the longitudinal length of the hinge rod. A pair of diametrically opposite generally planar parallel surfaces are formed along the longitudinal length of the hinge rod and interconnect the arcuate cam surfaces. The configuration of the hinge rod and its orientation relative to the snowshoe frame, coupled with the configuration of the retainer plate, are such that the claw plate encounters relatively minimal resistance to snap-on assembly onto and release from the hinge rod when the claw plate is disposed in an upwardly inclined angle, such as approximately 45°, relative to the plane of the snowshoe frame. The hinge rod and bushing present substantially greater resistance to release of the claw plate, and thereby the user's foot to which the claw plate is secured by the binding, when the claw-plate is in its normal range of pivotal movement relative to the frame so as not to allow inadvertent release during use of the snowshoe. The hinge rod and bushing also provide relatively minimal resistance to initial upward pivot movement of the heel portion of the user's foot to initiate each successive step of the snowshoe, but provide progressively increased resistance to continued upward pivotal movement of the claw plate as it approaches an angular position of approximately 45° relative to the frame. At this time, continued movement of the user's foot and leg in a forward stepping action lifts the snowshoe from the snow surface. The increased resistance to upward pivotal movement of the foot plate also serves to bias the snowshoe to remain in its angular relation to the foot plate and user's foot during lifting so as to prevent or dampen any tendency of the snowshoe frame to freely rotate about the hinge rod and slap against the user's heel. In this manner, a shock absorbing action is achieved which substantially prevents the tail of the snowshoe from imparting impact forces against the user's heel, and prevents the toe of the snowshoe from engaging the user's shin or ankle. By providing snap-on mounting of the claw plate onto the hinge rod, claw plates having different bindings and/or different cleat or calk configurations on their lower surfaces may be readily interchanged to accommodate different snow and terrain conditions and the proficiency of the user.

A feature of the snowshoe in accordance with the present invention lies in the arrangement for securing the marginal peripheral edge of the sheet-type decking or floatation material to the perimeter frame. The decking is formed from of an impervious high strength sheet material which extends substantially the full length of the perimeter frame. The outer marginal edge of the decking is secured to the frame by a plurality of connector straps each of which is looped about the frame and has its ends secured in overlapping sandwiched relation to an adjacent edge portion of the decking by a rivet. At least the rearward portion of the decking also has its marginal edge secured to the adjacent frame by a lashing member which has its opposite ends fixed to laterally opposite riveted connector straps by cage clips. The remainder of the lashing member is spirally looped about the frame and passes through openings in the decking to retain it fixed to the frame. The lashing member serves as a safety backup to retain the decking secured to the frame in the event a rivet connection were to fail.

Further objects, features and advantages of the snowshoe in accordance with the present invention will become apparent from the following detailed description taken in conjunction with the accompanying drawings wherein like reference numerals designate like elements throughout the several views.

DETAILED DESCRIPTION

Figure 1:
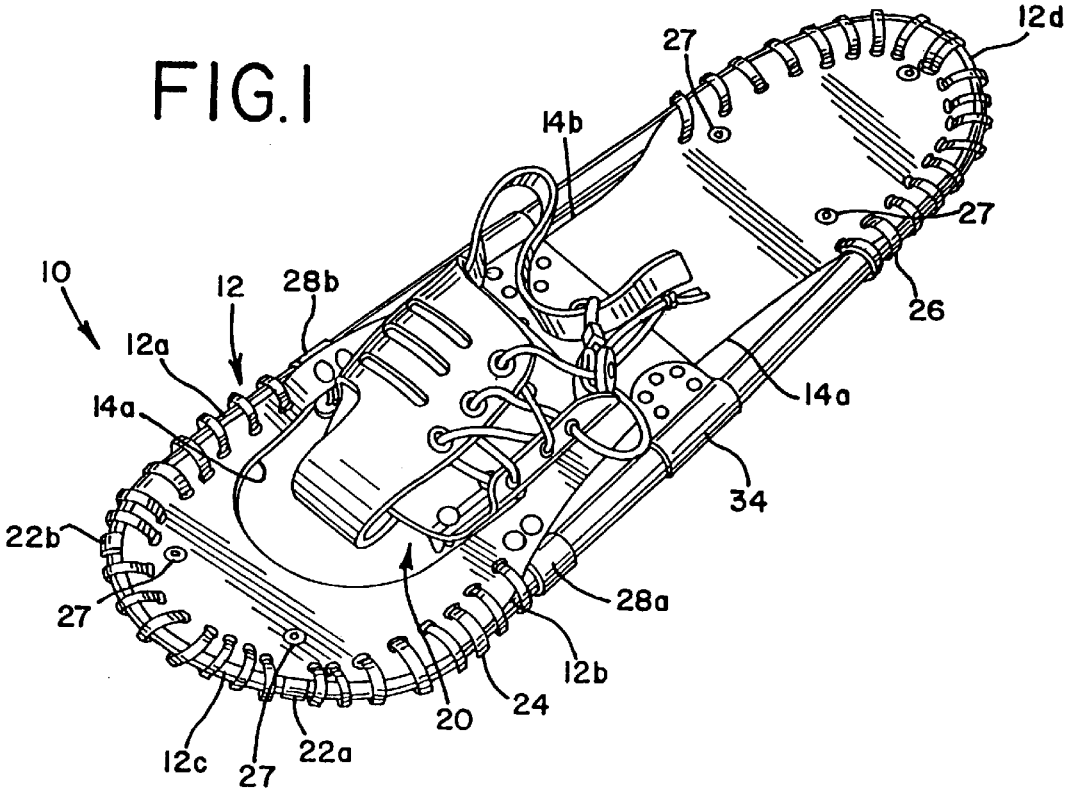
FIG. 1 is a perspective view of a snowshoe constructed in accordance with the present invention.
Figure 2:
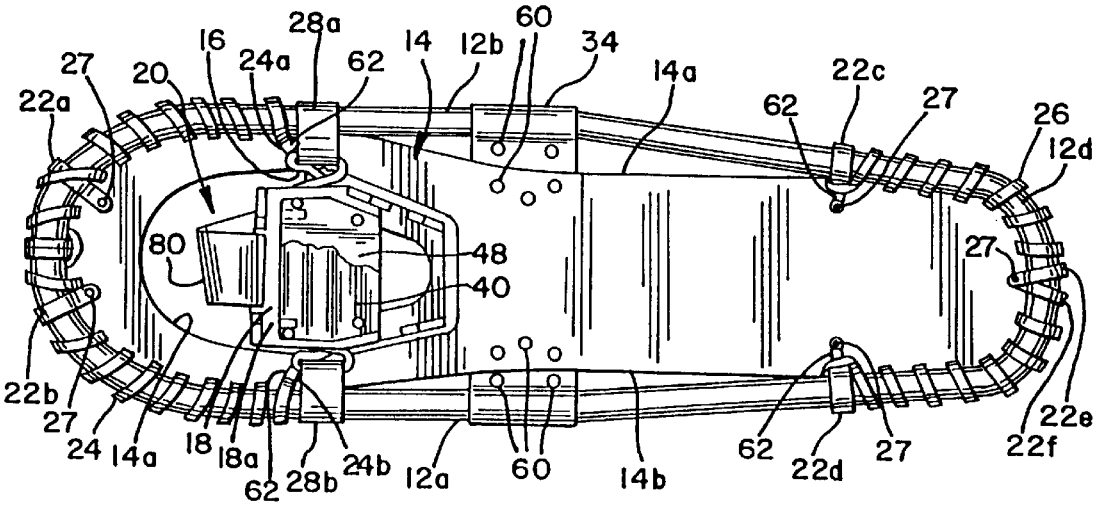
FIG. 2 is a bottom view of the snowshoe of FIG. 1.
Figure 3:
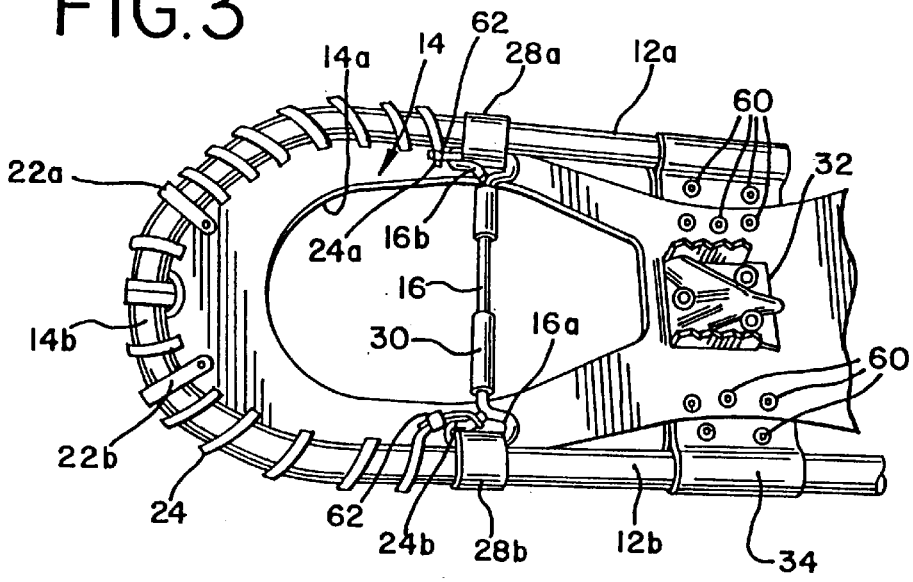
FIG. 3 is a fragmentary bottom view of the snowshoe of FIG. 1 but with the claw plate and binding removed and the bearing sleeve or bushing broken away for clarity.

Referring now to the drawings, and in particular to FIGS. 1–3, a snowshoe constructed in accordance with a preferred embodiment of the present invention as indicated generally at 10. Briefly, the snowshoe 10 includes a perimeter frame 12 to which is affixed floatation means 14 in the form of a closed sheet-type decking material that extends substantially the full longitudinal length and transverse width of the frame. The floatation means 14 facilitates support of the snowshoe on powder snow, as is known. Hinge rod means in the form of a hinge rod 16 (FIG. 3) has its opposite ends secured to the frame 12 so as to extend transversely of the frame across an opening 14*a* in the floatation means. The hinge rod 16 is positioned to underlie the ball of a user's foot when the snowshoe is attached to the user's shoe or the like. As will be described, the hinge rod 16 is adapted to have a claw plate 18, alternatively termed a foot plate or binding support plate, releasably mounted thereon in a snap-on manner to enable pivotable movement of the claw plate and associated binding between a position wherein the claw plate is generally coplanar with the frame 12 and an upward pivotable position forming an included angle of approximately 45° with the plane of the frame.

The claw plate 18 supports a binding, indicated generally at 20, which is affixed to an upper generally planar surface of the claw plate and facilitates attachment of the snowshoe to a user's shoe or the like, as illustrated in FIG. 9. The binding 20 is described in detail in pending U.S. application Ser. No. 08/239,268, filed May 6, 1994, which is incorporated herein by reference. The snowshoe 10 comprises one of a pair of snowshoes which are virtual mirror images of each other, the snowshoe 10 being intended to be worn on the user's right foot.

Turning now to a more detailed description of the snowshoe 10, the frame 12 is preferably made of a suitable strength, non-corrosive, lightweight tubular metallic material, such as aluminum. If desired, the frame 12 may also be made from other materials such as wood or suitable strength plastic. The frame 12 forms a closed loop having generally parallel coplanar side rail portions 12*a* and 12*b* which establish a lateral width of approximately 9 inches at the point of attachment of the hinge rod 16. The side rail portions 12*a* and 12*b* terminate at their forward ends in a forward rounded end frame portion 12*c*. The forward end portion 12*c* is inclined upwardly relative to the plane of the side rails at an angle of inclination of approximately 25°–30° so as to increase upward floatation in powder snow. Other angles of inclination may be selected if desired. The side rail frame portions 12*a* and 12*b*, taper slightly inwardly toward each other at the rearward end of the frame in symmetrical fashion about the longitudinal centerline of the frame and terminate at their rearward ends in a rounded tail end frame portion 12*d* so as to establish a longitudinal length of approximately 32 inches for the snowshoe, although other length snowshoes may also be desired.

In the illustrated embodiment, the floatation or decking sheet 14 comprises a single piece of suitable snow and water impermeable sheet material which preferably is relatively lightweight but has sufficient tear and shear resistance for its intended purpose. The floatation or decking sheet 14 is particularly adapted for backcountry snowshoeing in powder snow but also finds application on running snowshoes because of its light weight. The floatation sheet 14 may be formed from 1000 denier nylon coated on its bottom surface with an abrasion resistant polyurethane. The top surface of the floatation sheet is generally not exposed to abrasive snow or other ground materials so may be coated with a suitable plastic material, such as PVC. Other suitable strength materials could also be used to form the floatation means, including traditional webbing laced tightly to the frame 12.

As will be described more fully below, the forward and rearward ends of the floatation or decking sheet material 14 are secured to the forward and rearward curved ends of the frame 12 by a plurality of connector straps 22 and a pair of lashing members or elements 24 and 26. The connector straps 22 are formed from a suitable strength material, such as the decking sheet material 14, and are looped around the frame at selected spaced positions along the frame. Each connector strap has its ends positioned in overlying or superimposed relation to each other and in underlying relation to the adjacent marginal edge of the floatation sheet 14. The overlying ends of each connector strap are secured to the adjacent edge of the decking by a suitable fastener, preferably a rivet or the like as indicated at 27. The lashing elements 24 and 26 are spirally wound around the frame with each loop passing through a suitable size opening in the adjacent decking sheet. The ends of the lashing elements 24 and 26 are fixed so that the lashing elements provides safety backup to retain the decking or floatation material secured to the frame in the event one or more of the rivet fasteners fails or releases from the decking sheet.

As aforedescribed, the hinge rod 16 is secured to the laterally opposite side portions 12*a* and 12*b* of the frame 12 so as to extend transversely of the longitudinal axis of the frame at a position to substantially underlie the ball of the user's foot to which the snowshoe is attached. The hinge rod 16 has opposite looped or eyelet-like ends 16*a* and 16*b* which are attached to the side rails 12*a* and 12*b*, respectively, by hinge rod connector straps 28*a* and 28*b* that are looped about the frame and through the corresponding looped ends of the hinge rod. The hinge rod straps have substantially greater transverse width than thickness and are preferably formed of a high strength woven nylon base fabric having a coating of polyurethane on the opposite side surfaces, and with a thicker bead of polyurethane along their perimeter edges to resist wear. The hinge rod straps are looped about their respective frame side rails and through the looped ends of the hinge rod 16 so that the hinge rod straps firmly secure the hinge rod to the frame.

A tubular low friction bearing sleeve or bushing 30, which may be made of polyethylene and alternatively termed a hinge rod bushing, is assembled in coaxial relation about the longitudinal length of hinge rod 16 between its looped ends. To facilitate assembly of the bearing sleeve or hinge rod bushing 30 over the hinge rod 16, the bushing may be slit along its longitudinal length, as indicated at 30*a* in FIG. 4. In this manner, the hinge rod bushing 30 may be readily changed so that bearing sleeves of different wall thicknesses may be utilized to vary the resistance to rotational or pivotal movement of the claw plate about the longitudinal axis of the hinge rod, as will be described.

Figure 4:
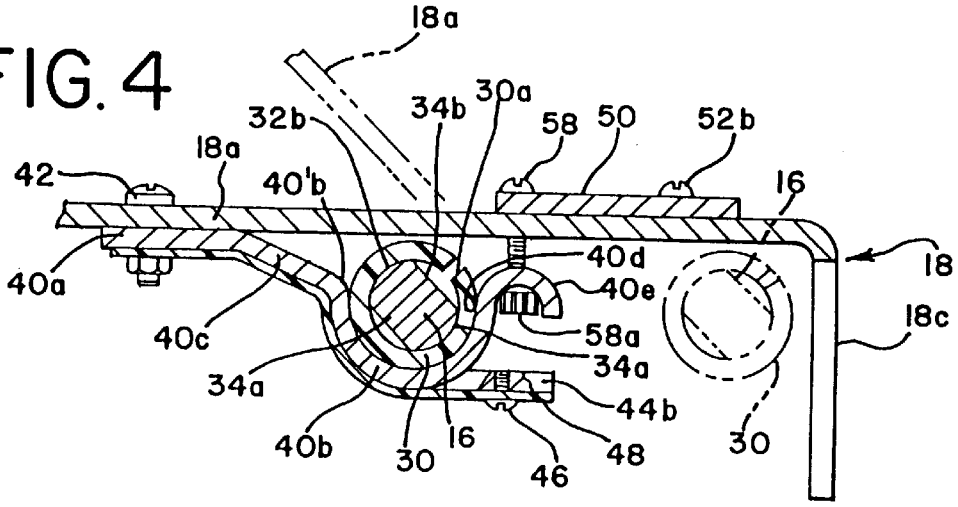
FIG. 4 is a fragmentary longitudinal sectional view, on an enlarged scale, illustrating the pivotal snap-on mounting arrangement of the claw plate on the hinge rod.
Figure 7:
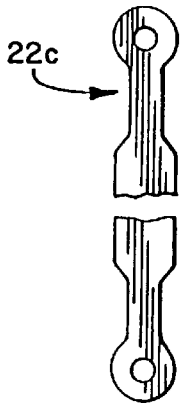
FIG. 7 is a foreshortened plan view of a connector strap used for connecting the laterally opposite marginal edges of the decking sheet to the frame by rivets.
Figure 5:
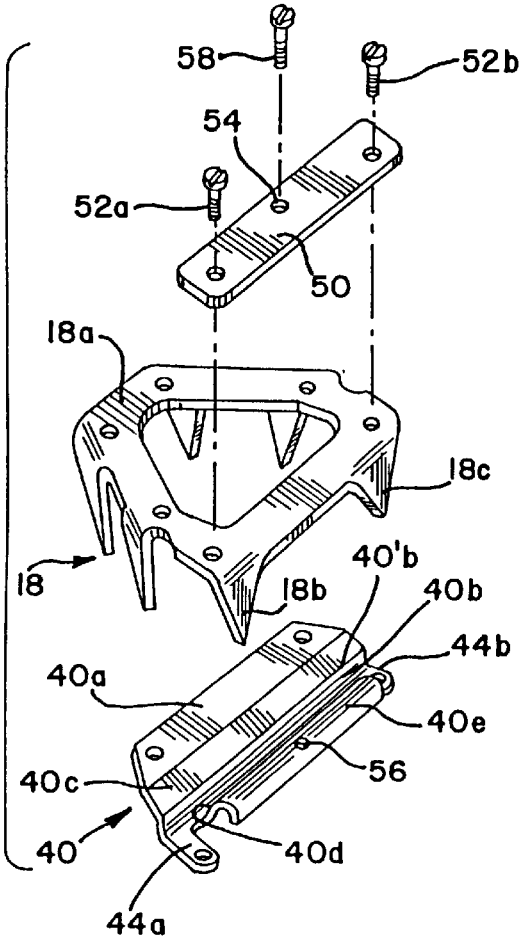
FIG. 5 is an exploded perspective view of the claw plate and retainer plate illustrated in FIG. 4.
Figure 6:
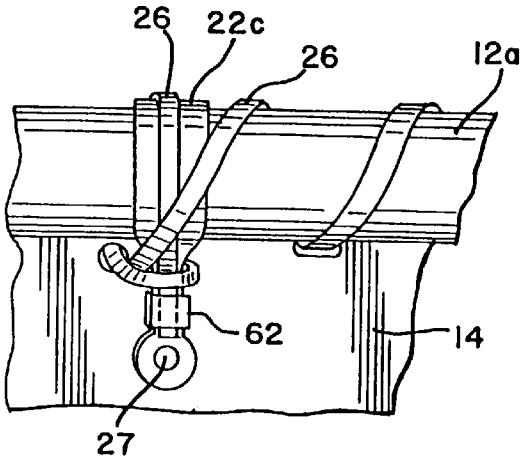
FIG. 6 is an enlarged fragmentary detail view illustrating the manner of securing the ends of the rearward lashing element to the lateral connector straps.

Referring to FIGS. 4 and 5, the foot plate or claw plate or binding support plate 18 is generally trapezoidal shaped in plane configuration and may be made of a suitable strength corrosion resistant material such as aluminum or stainless steel. The claw plate 18 has a generally planar plate portion or planar portion 18*a* the upper surface of which is attached to and supports the binding 20. In the illustrated embodiment, the claw plate 18 has a pair of downwardly directed laterally spaced cleats or calks 18*b* and 18*c* formed at its forward transverse edge and has similar downwardly directed right-angle cleats or calks formed integral with lateral edges of the claw plate. Alternative cleat or crampon or calk designs may be selected for different snow and terrain conditions to provide improved traction. If desired, a claw 32 (FIG. 3) may also be secured to the underside of the decking 14 beneath a transverse support web or strap 34 to prevent the trailing end of the snowshoe from sliding laterally on hard packed snow or when traversing inclined slopes.

The claw plate 18 includes retainer plate means in the form of a metallic retainer or retainer plate 40 which, as illustrated in FIG. 4, is secured to the lower surface of the planar portion 18*a* of the claw plate. The retainer plate 40 includes a planar plate portion or plate portion 40*a* and a generally U-shaped portion 40*b*. The U-shape and planar portion of the foot plate forms a mounting compartment for confining the hinge rod. The mounting compartment has a top, a bottom, and two sides. The planar portion of the foot plate forms the top of the mounting compartment. The U-shape has a bottom portion and two side portions which form the bottom and two sides of the mounting compartment. The plate portion 40*a* of the retainer plate is secured to the lower surface of the claw plate by a pair of screws and locknuts 42 so that the U-shaped portion 40*b* extends transversely of the longitudinal axis of the claw plate. The forward end of claw plate 18 and the retainer plate 40 have transverse widths substantially equal to the length of the hinge rod 16 between its looped ends 16*a* and 16*b*.

The U-shaped portion 40*b* of the retainer plate is formed with a fixed radius of curvature generally equal to one-half the diameter of the outer surface of the bearing sleeve or bushing 30 when mounted on the hinge rod 16. A rearward edge 40'*b* of the U-shaped portion 40*b* is connected to the plate portion 40*a* through a generally planar wall 40*c* which is inclined downwardly from the plane of the plate portion 40*a* at an angle of approximately 30°. The inclined portion, or snap off plate, or inclined wall 40*c* enhances the spring or snap action of the U-shaped portion 40*b* of the retainer plate when the claw plate is assembled onto the hinge rod 16 and bushing 30, and also creates a space rearwardly of the U-shaped hinge rod receiving portion 40*b* to receive snow which might otherwise inhibit mounting of the claw plate onto the hinge rod.

The forward lateral edge of the uniform radius U-shaped portion 40*b* of the retainer plate preferably terminates in a relatively flat or planar wall portion 40*d* which lies in a plane generally normal to the plate portion 18*a* of the claw plate. The lower transverse marginal edge of the planar wall portion 40*d* lies substantially in a plane parallel to the planar plate portion 18*a* of the claw plate and passing through the longitudinal center axis of the hinge rod 16. A reversely curved generally uniform radius forward wall or bias portion or snap on bias portion 40*e* is formed integral with the upper edge of the planar wall portion 40*d* and serves as a cam surface. The uppermost surface of the reversely curved wall 40*e* and the axis of the uniform curvature wall 40*b* are spaced, respectively, predetermined distances below the lower surface of the planar plate portion 18*a* of the claw plate so as to enable the claw plate to be assembled onto the hinge rod 16 and sleeve bushing 30 with a predetermined spring or snap-on action. In this manner, with the claw plate 18 and retainer plate 40 secured to a user's foot through the binding 20 but released from the snowshoe 10, movement of the claw plate to a position wherein the lower surface of the plate portion 18*a* just behind the cleats 18*b,c* engages the hinge rod 16 and bushing 30, such as ilustrated in phantom in FIG. 4, enables the claw plate to be moved in a forward direction so that the retainer plate undergoes a spring action with the reversely curved surface 40*e* on the retainer plate 40 being cammed downward by the bushing. Continued forward movement of the claw plate causes the hinge rod 16 and bushing 30 to be received within the U-shaped portion 40*b* of the retainer plate which springs or snaps back to capture the hinge rod and bushing between the retainer plate and planar portion 18*a* of the claw plate. Thereafter, the claw plate may pivot about the axis of the hinge rod 16 in response to articulation of the user's foot in a conventional snowshoeing movement.

As illustrated in FIG. 5, the retainer plate 40 is preferably formed with a pair of laterally spaced tabs 44*a* and 44*b*. Each tab 44*a,b* has a taped hole formed therethrough to receive a screw (indicated at 46 in FIG. 4) for securing a sheet 48 of flexible coated nylon to the lower surface of the retainer plate so as to inhibit adherence of snow to the retainer plate, the rearward end of sheet 48 being secured by the nuts on screws 42.

In the illustrated embodiment, the length of the hinge rod 16 between its oblong looped ends 16*a* and 16*b* is formed with a non-circular cross section so as to define at least one, and preferably a pair of cam surfaces 32*a* and 32*b* which effect progressively increasing frictional resistance to pivotal movement of the claw plate 18 relative to the frame means 12 as the tail end of the claw plate pivots upwardly about the hinge rod. The cam surfaces 32*a* and 32*b* are formed as diametrically opposite outwardly facing arcuate segments of a cylinder the axis of which coincides with the longitudinal axis of the hinge rod. The arcuate cam surfaces 32*a* and 32*b* are interconnected by laterally opposite generally planar parallel surfaces 34*a* and 34*b* which are equally spaced from the longitudinal axis of the hinge rod and may be defined as chord surfaces on the hinge rod.

The cam surfaces 32*a,b* and planar surfaces 34*a,b* are formed on the hinge rod so that the planar surfaces 34*a,b* normally lie in parallel planes forming included angles of approximately 45° with the plane of the side frame rails 12*a* and 12*b*, as illustrated in FIG. 4. The diametrical distance between the cam surfaces 32*a* and 32*b*, coupled with the wall thickness of the bearing sleeve or rod bushing 30, the radius of curvature of the U-shaped portion 40*b* of the retaining plate 40, and the distance between the center axis of the U-shaped portion 40*b* and the lower surface of the claw plate portion 18*a* establish a geometrical relation enabling relatively free upward pivotal movement of the rearward end of the claw plate about the hinge rod during initial upward pivotal movement from its lowered position generally coplanar with the side rails 12*a* and 12*b* of the frame means. It will be appreciated that with the parallel planar surfaces 34*a* and 34*b* spaced apart a lesser distance than the diameter of the cam surfaces 32*a,b*, orientation of the user's foot so as to position the attached claw plate 18 at an inclined angle of approximately 45° to the plane of the frame side rails 12*a,b*, such as indicated in phantom in FIG. 4, prior to mounting the claw plate onto the hinge rod will enable the claw plate to be mounted on the hinge rod and bushing 30 with less forward force required than is the case if the forward reversely curved surface 40*e* of the retainer plate must be opened to receive full diameter of the cam surfaces 32*a,b* and bushing 30.

When it is desired to release the claw plate 18 from the snowshoe, as when selecting a different claw plate having a different binding thereon or having a different cleat or calk arrangement for a particular snow or terrain condition, the claw plate may be pivoted upwardly to an inclined angle of approximately 45° relative to the frame 12. In this position, the claw plate may be moved rearwardly to release the retainer plate 40 from the hinge rod 16 and bushing 30.

With the claw plate 18 retained on the hinge rod 16 and bushing 30 by the retainer plate 40, as the claw plate pivots upwardly about the hinge rod 16 in response to movement of the snowshoer's foot, and particularly as the claw plate approaches a inclined angle of approximately 45° with the plane of the frame side rails 12*a* and 12*b*, the cam surfaces 32*a* and 32*b* effect progressively increased frictional resistance to upward rotation or pivotal movement of the claw plate about the hinge rod. By controlling the wall thickness of the bearing sleeve or rod bushing 30, the frictional resistance to relative pivotal movement between the claw plate and the hinge rod 16 can be varied. Such increased frictional resistance to rotation of the claw plate relative to the frame prevents the frame means from freely rotating or flopping about the axis of the hinge rod with possible engagement of the toe portion of the snowshoe against the shin or ankle of the user. Similarly, this action prevents snapping of the tail end of the snowshoe against the user's heel and thus acts as a shock absorber to prevent annoying noise and imparting of an impact force against the user's heel.

Conversely, as the snowshoe is moved forwardly with the claw plate 18 in its upward pivotal position relative to the frame means 12, and with the frame means and floatation means 14 raised from the surface of the snow, as in jogging or running, resistance to downward pivotal movement of the claw plate and user's foot relative to the frame decreases as the snowshoe is lowered to again engage the surface of the snow. This is due to the interaction of the hinge rod cam surfaces with the retainer plate 40, bearing sleeve 30 and planar portion 18*a* of the claw plate which tends to bias the hinge rod to its original position wherein the claw plate is again generally parallel to the plane of the frame side rails 12*a* and 12*b*.

It will be appreciated that with the claw plate 18 mounted on the hinge rod 16 and bushing 30 as described, varying the wall thickness of the bearing sleeve or rod bushing 30 will vary the frictional relation between the hinge rod and the claw plate throughout the full range of pivotal movement of the claw plate. Thus, use of a relatively thin wall bearing sleeve or bushing will result in relatively little resistance to pivotal movement of the claw plate about the hinge rod. This condition is particularly desirable in backcountry powder snowshoeing wherein it is desired that the tail end of the snowshoe remain on the snow surface so that the user does not waste energy lifting snow which has accumulated on top of the snowshoe. In jogging or running on snowshoes, the user may wish to inhibit the freedom of pivotal movement of the claw plate about the hinge rod so that the snowshoe does not flop around or slap against the user's foot or engage the user's shin or ankle. In this case, a thicker wall bearing sleeve or bushing would be selected to increase the frictional resistance to pivotal movement of the frame means relative to the claw plate and user's boot when the snowshoe is raised from the snow surface.

As an alternative to changing the bearing sleeve or bushing 30 to vary the frictional relation between the claw plate 18 and hinge rod 16, the claw plate 18 and retainer plate 40 may have adjustment means for interconnecting the retainer plate to the planar portion 18*a* of the claw plate so as to vary the clamping action of the retainer plate against the bushing 30. Referring to FIGS. 4 and 5, a rectangular plate or bracket 50 is secured to the upper surface of the planar plate portion 18*a* of the claw plate 18, as by screws 52*a* and 52*b*. The plate 50 has an opening 54 centrally of its length which overlies an opening in the plate 18*a* and also overlies an opening 56 in the reversely curved portion 44*e* of the retainer plate 44. A screw 58 is inserted through the aligned openings 54 and 56 and has a locknut 58*a* secured on its lower end so that the nut underlies the curved portion 40*e* of the retainer plate. After mounting the claw plate 18 onto the hinge rod 16 and bushing 30 in a snap-on manner as aforedescribed, the screw 58 and nut 58*a* are secured between the plate 50 and the reversely curved portion 40*e* of the retainer plate. The nut is tightened against the underside of the retainer plate portion 40*e* to draw U-shaped portion 40*b* of the retainer plate against the bushing to achieve the desired frictional relation, either loosely to effect low friction or relatively tightly so as to prevent inadvertent release of the claw plate from the snowshoe hinge rod.

As aforedescribed, the hinge rod connector straps 28*a* and 28*b* cooperate with the looped ends 16*a* and 16*b* of the hinge rod 16 to generally maintain the hinge rod in fixed rotational relation to the snowshoe frame 12. However, when the claw plate 18 has reached an upward angular position of approximately 45° relative to the snowshoe frame, the hinge rod straps 28*a* and 28*b* undergo a twisting action. The hinge rod straps resist such twisting action and thereby serve as a further shock absorber element in resisting upward movement of the claw plate relative to the frame. This action further enhances the shock absorber characteristics of the snowshoe.

By creating increased resistance to pivotal movement of the claw plate about the hinge rod when the claw plate has reached an upward pivotal angle of approximately 45° relative to the snowshoe frame, a snowshoer can readily raise the snowshoe from the snow surface with the frame and floatation means remaining in relatively fixed relation to the user's foot. This permits backward movement or stepping without the tail end of the snowshoe frame dropping into the snow and inhibiting backstepping. This is particularly desirable when the snowshoer is confronted with an obstacle such as a fallen tree or the like, termed a deadfall, which is covered by loosely packed snow so that the snowshoer could drop downwardly into a pocket or void in the powder snow. Upon approaching such an obstacle, the snowshoer should immediately change direction as by backstepping.

As illustrated in FIGS. 1 and 2, the decking or floatation sheet 14 has an outer peripheral contour so that the forward and rearward marginal edge portions of the decking sheet can partially overlap the adjacent ends of frame 12. The portion of the decking sheet which extends along the mid-length of frame 12 is necked inwardly, as at 14*a* and 14*b*, so as to be spaced inwardly from the lateral side portions 12*a* and 12*b* of the frame and create openings through which snow on the upper surface of the decking sheet may pass. The transverse relatively wide support or reinforcing web or strap 34 extends across the upper surface of the decking sheet 14 and has its opposite ends looped around the lateral frame portions 12*a* and 12*b* so as to be folded back in overlying relation on the support strap. Each overlying end portion of support strap 34 is secured to the underlying decking sheet 14 by a plurality of rivets 60 so as to support the mid-length of the decking sheet relative to the frame.

The forward lashing element 24, which is preferably made of a suitable strength weather resistant plastic material, has its opposite ends 24*a* and 24*b* looped through the eyelet ends 16*a* and 16*b*, respectively, of the pivot rod 16 and secured by crimped metallic non-corrosive cage clips 62. As shown is FIGS. 1 and 2, the lashing element 24 is spirally wound about the forward frame end 12*c* with each loop of the spiral winding passing through an opening in the adjacent decking material so as to lash the forward end of the decking to the frame and serve as a safety backup fastener in the event the riveted connector straps 22*a* and 22*b* fail or release from the decking sheet.

Figure 8:
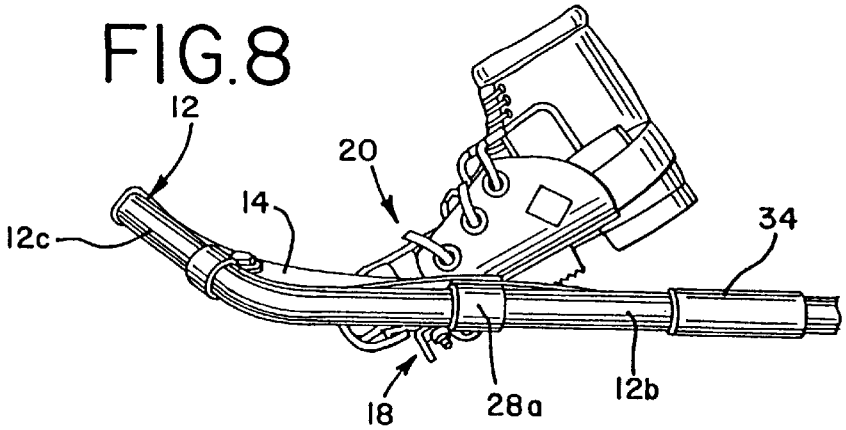
FIG. 8 is a fragmentary side elevational view showing the claw plate and binding in an upwardly pivoted position relative to the snowshoe frame.

In similar fashion, a pair of laterally opposite connector straps 22*c* and 22*d* are looped about the lateral side frame portions 12*a* and 12*b* toward the rear of the frame. The connector straps 22*c* and 22*d* have their ends secured in overlying relation to the underside of the decking sheet 14 by single rivets 27. The connector straps 22*c* and 22*d* preferably are formed to a plan configuration as shown in FIG. 8 so that a reduced width neck portion is formed adjacent each end of the strap. The reduced width neck portions are disposed in overlying relation when the straps 22*c* and 22*d* are looped about the frame and facilitate fixed connection of the ends of a lashing member to these connector straps, as will be described.

A pair of connector straps 22*e* and 22*f* similar to connector straps 22*a* and 22*b* are looped about the rearward tail end 12*d* of the snowshoe frame at its longitudinal center. The ends of both connector straps 22*e* and 22*f* are disposed in overlying relation and fixed to the underside of the decking sheet 14 by a rivet 27. In this manner the rear or tail end of the decking sheet 14 is prevented from shifting laterally relative to the longitudinal center axis of the frame 12. Preferable, a suitable washer is interposed between the head of each rivet and the decking sheet, and between the swaged end of each rivet and the associated connector strap.

The lashing element 26 is similar to lashing element 24 and has its opposite ends securely fixed to the overlying reduced-width neck portions of each connector strap 22*c* and 22*d* by means of a metallic tubular cage clip 62 which is crimped tight to the associated connector strap. The remainder of lashing element 26 is spirally wound around the tail end 12*d* of frame 12 with each loop passing through an opening or hole through the adjacent marginal edge of the decking sheet 14 so as to securely attach the rear end of the decking sheet to the frame and provide a safety backup in the event any of the rivet connections of connector straps 22*c–f* fail or otherwise release from the decking sheet. The marginal edge of the rear end of the decking sheet partially laps the frame and is held against the frame by the spiral lashing element 26.

Having thus described a preferred embodiment of a snowshoe and snap-on claw plate in accordance with the present invention, it will be appreciated that the snowshoe may be readily adapted for various snow and terrain conditions, as well as for different user proficiency, by enabling easy interchanging of the claw plate and associated binding. The claw plate and retainer plate enable a relatively free pivotal relation between the claw plate and the snowshoe frame, or allow a relatively high friction resistance to pivotal movement of the claw plate about the hinge rod 16 and bushing 50.

While a preferred embodiment of the snowshoe in accordance with the present invention has been illustrated and described, it will be understood to those skilled in the art that changes and modifications may be made therein without departing from the invention in its broader aspects. Various features of the invention are defined in the following claims.

What is claimed is:

1. A snowshoe with snap on mounting comprising:

a. a frame defining a longitudinal axis and forming a perimeter of the snowshoe, b. floatation means carried by said frame, c. a hinge rod secured to said frame in transverse relation thereto, d. a mounting compartment, having a top, a bottom, and two sides, said mounting compartment mounted around said hinge rod, e. a foot plate forming said top, f. a retainer including a bottom portion forming said bottom and two side portions forming said two sides, g. said retainer having a plate portion which is connected to one of said side portions, h. said plate portion attached to said foot plate, i. said side portions and said bottom portion of the retainer plate being substantially U-shaped, said retainer plate having a reverse curvature portion connected to a side portion which is not connected to said plate portion, said reverse curvature portion forming a snap on bias portion which biases to an open position to receive said hinge rod, whereby a snowshoe with snap on mounting is accomplished.

2. The snowshoe with snap on mounting of claim 1 with means for connecting said reverse curvature portion to said top.

3. A snowshoe with binding with snap on mounting comprising the snowshoe of claim 1 further including binding means for attaching a user's foot, said binding means attached to said foot plate whereby a snowshoe with binding with snap on mounting is accomplished.

4. A snowshoe with crampon with snap on mounting comprising the snowshoe of claim 1 further including said planar portion connected to a crampon.

5. A snowshoe with snap off mounting comprising:

a. a frame defining a longitudinal axis and forming a perimeter of the snowshoe, b. floatation means carried by said frame, c. a hinge rod secured to said frame in transverse relation thereto, d. a mounting compartment, having a top, a bottom, and two sides, said mounting compartment mounted around said hinge rod, e. a foot plate forming said top, f. said foot plate having a planar portion, g. a retainer including a bottom portion forming said bottom and two side portions forming said two sides, h. said retainer having an inclined portion connected to one of said side portions, i. said retainer having a plate portion connected to said inclined portion, j. said plate portion attached to said foot plate, k. said inclined portion further defined as a snap off plate inclined relative to said planar portion to enable spring action of said inclined portion, whereby a snowshoe with snap off mounting is accomplished.

6. A snowshoe with snap on, snap off mounting comprising the snowshoe with snap off mounting as claimed in claim 5 wherein said side portions and said bottom portion of the retainer being substantially U-shaped, said retainer plate having a reverse curvature portion connected to a side portion which is not connected to said inclined portion, said reverse curvature portion forming a snap on bias portion which biases to an open position to receive said hinge rod, whereby a snowshoe with snap on, snap off mounting is accomplished.

7. The snowshoe with snap on, snap off mounting of claim 6 with means for connecting said reverse curvature portion to said top.

8. A snowshoe with binding with snap on, snap off mounting comprising the snowshoe of claim 6 further including binding means for attaching a user's foot, said binding means attached to said foot plate whereby a snowshoe with binding with snap on, snap off mounting is accomplished.

9. A snowshoe with crampon with snap on, snap off mounting comprising the snowshoe of claim 6 further including said planar portion connected to a crampon.

10. The snowshoe with snap off mounting of claim 5 wherein said side portions and said bottom portion of the retainer being substantially U-shaped, said retainer plate having a reverse curvature portion connected to a side portion which is not connected to said inclined portion, with means for connecting said reverse curvature portion to said top.

11. A snowshoe with binding with snap off mounting comprising the snowshoe of claim 5 further including binding means for attaching a user's foot, said binding means attached to said foot plate whereby a snowshoe with binding with snap off mounting is accomplished.

12. A snowshoe with crampon with snap off mounting comprising the snowshoe of claim 5 further including said planar portion connected to a crampon.

* * * * *